United States Patent [19]

Shekleton et al.

[11] Patent Number: 5,001,895

[45] Date of Patent: Mar. 26, 1991

[54] FUEL INJECTOR FOR TURBINE ENGINES

[75] Inventors: Jack R. Shekleton, San Diego; John P. Archibald, La Jolla, both of Calif.

[73] Assignee: Sundstrand Corporation, Rockford, Ill.

[21] Appl. No.: 280,940

[22] Filed: Dec. 7, 1988

Related U.S. Application Data

[62] Division of Ser. No. 133,491, Dec. 14, 1987.

[51] Int. Cl.[5] ..... F02C 3/05

[52] U.S. Cl. ..... 60/39.36; 60/738

[58] Field of Search ..... 60/39.36, 737, 738, 60/740, 748, 39.826; 234/403, 424

[56] References Cited

U.S. PATENT DOCUMENTS

| | | | |
|---|---|---|---|
| 3,088,779 | 5/1963 | Diedrich | 60/39.826 |
| 3,531,937 | 10/1970 | Sneeden | 60/738 |
| 3,613,360 | 10/1971 | Howes . | |
| 3,748,852 | 7/1973 | Cole et al. . | |
| 3,972,182 | 8/1976 | Salvi . | |
| 3,980,233 | 9/1976 | Simmons et al. . | |
| 4,081,957 | 4/1978 | Cox, Jr. | 60/737 |
| 4,105,163 | 8/1978 | Davis, Jr. et al. . | |
| 4,198,815 | 4/1980 | Bobo et al. . | |
| 4,265,615 | 5/1981 | Lohmann et al. . | |
| 4,478,045 | 10/1984 | Shekleton | 60/737 |
| 4,534,166 | 8/1985 | Kelm et al. . | |
| 4,549,402 | 10/1985 | Saintsbury et al. . | |
| 4,584,834 | 4/1986 | Koshoffer et al. . | |
| 4,638,636 | 1/1987 | Cohen . | |
| 4,653,778 | 3/1987 | Vinson et al. | 60/737 |

*Primary Examiner*—Louis J. Casaregola
*Assistant Examiner*—Timothy S. Thorpe
*Attorney, Agent, or Firm*—Wood, Phillips, Mason, Recktenwald & VanSanten

[57] ABSTRACT

A fuel injector 46 for a turbine engine includes an elongated, generally cylindrical metal casting 76 having a cylindrical surface 78 terminating in an end 84 having a frustoconical surface 86. A bore 88 having an axis 89 normal to the frustoconical surface 86 extends through the casting 76 to provide an air inlet 90 in the cylindrical surface 78 and a fuel and air outlet 94 in the frustoconical surface 86. The bore 88 is narrowed at the outlet to provide a constriction 110 thereat. A curved tube 96 of substantially lesser diameter than the bore 88 is located within the bore 88 to serve as a fuel injecting tube and has an open end 100 on and normal to the axis 89 and located in close adjacency to the constriction 110 without increasing the resistance to air flow through the constriction 110.

5 Claims, 2 Drawing Sheets

FIG. 1
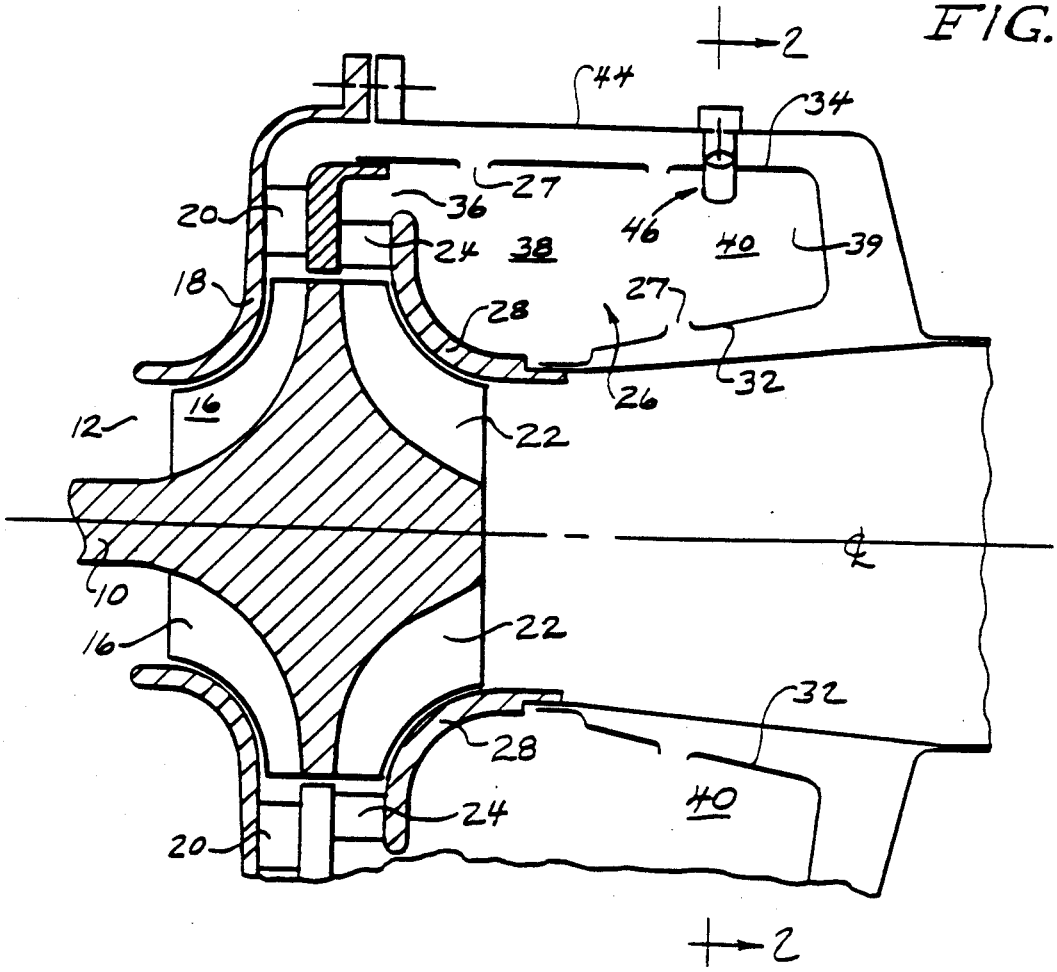
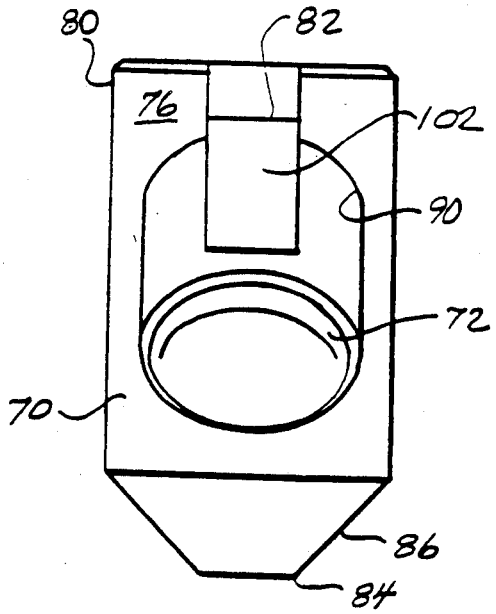
FIG. 3

FUEL INJECTOR FOR TURBINE ENGINES

This is a division of application Ser. No. 133,491 filed Dec. 14, 1987 now allowed.

FIELD OF THE INVENTION

This invention relates to turbine engines, and more particularly, to improved fuel injectors for turbine engines and turbine engines employing the same.

BACKGROUND OF THE INVENTION

The most pertinent prior art known to the applicant includes U.S. Letters Pat. No. 3,613,360 issued Oct. 19, 1971 to Howes.

Conventional annular combustors employed in air breathing turbines have a large number of fuel injectors. In small gas turbines this causes numerous difficulties and becomes impractical. For example, fuel consumption will decrease as turbine size is decreased and that will in turn require a decrease in the fuel passage size of each fuel injector if desired atomization is to be obtained. However, as fuel passage size is reduced, clogging problems increase significantly. This in turn can lead to the development of undesirable hot spots as well as combustion inefficiencies.

Furthermore, in small turbine engines, low speed operations may be difficult due to low air velocity and the resulting poor atomization of fuel, which in turn causes unreliable and/or inefficient combustion.

The present invention is directed to overcoming one or more of the above problems.

SUMMARY OF THE INVENTION

It is the principal object to provide a new and improved turbine engine. More specifically, it is an object of the invention to provide a turbine engine with new and improved fuel injectors that are ideally suited for use in small turbine engines. It is also a principal object of the invention to provide a new and improved fuel injector.

According to one facet of the invention, the foregoing objects are achieved in a turbine engine including a rotatable turbine wheel, a rotary compressor coupled to the turbine wheel, and an annular combustor for receiving compressed air from the compressor and fuel from a fuel source and burning the same to provide gasses of combustion to drive the turbine wheel. The combustor includes a radially inner annular combustion zone surrounded by a radially outer annular compressed air manifold defined by spaced inner and outer walls with the inner wall defining the outer extremity of the combustion zone. A plurality of angularly spaced injector assemblies are mounted on the outer wall and extend through the inner wall into the combustion zone. Each injector assembly includes an elongated body having a hollow interior with a port at one end opening into the combustion zone generally tangentially thereto. A venturi surface is disposed in the hollow interior just inwardly of the port and the body further includes at least one inlet to the hollow interior located in a side of the body between the inner and outer walls. A fuel injecting tube is disposed within the hollow interior and terminates within the hollow interior adjacent the port in an open end in alignment with the open end and generally tangential to the combustion zone. The open end of the tube is located as close to the venturi surface as is possible without the tube substantially increasing the resistance of the flow of air from the hollow interior through the port.

In a preferred embodiment, the tube is a somewhat J-shaped tube and in addition, includes swirler means on its interior upstream of its open end.

In a highly preferred embodiment, each injector assembly is located generally on a radius of the combustion zone.

The invention also contemplates the provision of a fuel injector for a turbine engine including an elongated, generally cylindrical metal casting having a cylindrical surface terminating in an end having a frustoconical surface. A bore having its axis normal to the frustoconical surface extends through the casting to provide an air inlet in the cylindrical surface and a fuel and air outlet in a frustoconical surface. The bore is narrowed at the outlet to provide a constriction thereat and a curved tube of substantially lesser diameter than the bore is at least partially within the bore to serve as a fuel injecting tube. The tube has an open end on and normal to the bore axis and is located in close adjacency to the constriction without increasing the resistance to air flow through the constriction.

In a preferred embodiment, the constriction includes an interior section of a torus to thereby provide a convex surface facing toward the inlet, and a cylindrical section extending from the interior section to the outlet.

The invention further contemplates the provision of a notch in the casting and specifically in the cylindrical surface thereof. The notch is of a width and a depth greater than the diameter of the tube and extends from the inlet to an end of the casting opposite the frustoconical surface. The notch receives part of the tube such that the tube is wholly within the cylindrical envelope of the casting to thereby facilitate assembly of the tube and the casting as a fuel injector and to further facilitate installation of the fuel injector in the combustor of a turbine engine.

Other objects and advantages will become apparent from the following specification taken in connection with the accompanying drawings.

DESCRIPTION OF THE DRAWINGS

FIG. 1 is a somewhat schematic sectional view of a turbine engine with fuel injectors made according to the invention;

FIG. 3 is an elevation of a casting forming part of a fuel injector housing.

DESCRIPTION OF THE PREFERRED EMBODIMENT

Figure 2:
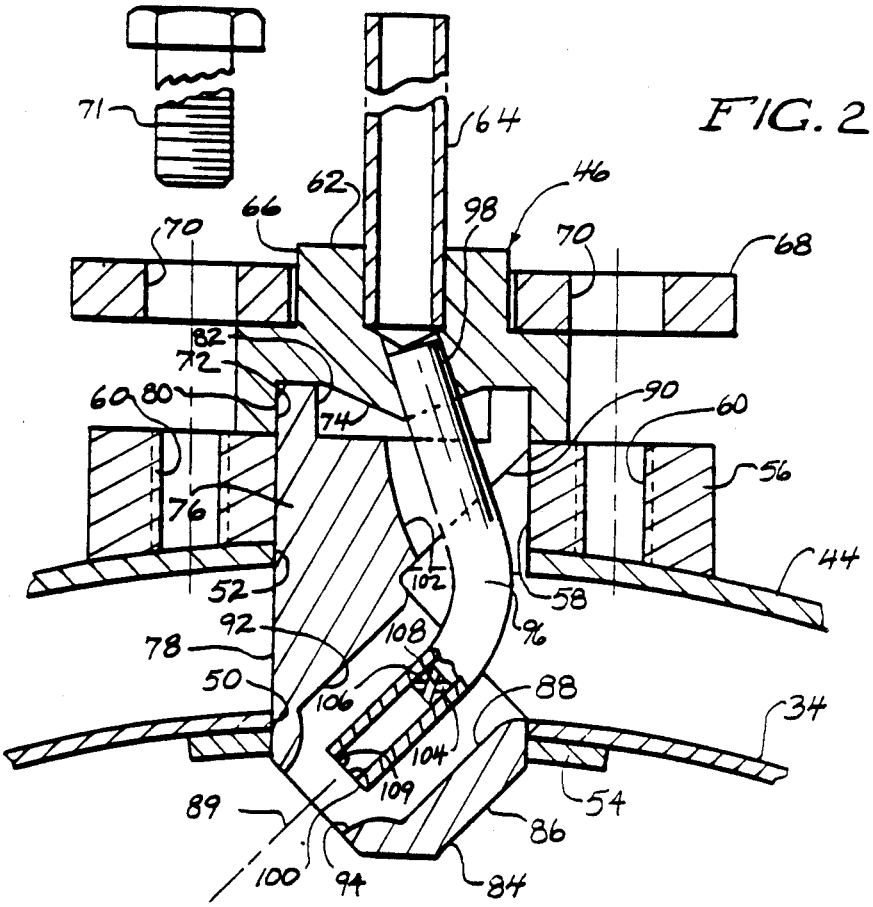
FIG. 2 is an enlarged, fragmentary sectional view of a fuel injector and taken approximately along the line 2—2 in FIG. 1.

An exemplary embodiment of a gas turbine made according to the invention is illustrated in the drawings in the form of a radial flow, air breathing gas turbine. However, the invention is not limited to radial flow turbines and may have applicability to any form of air breathing turbine having an annular combustor.

The turbine includes a rotary shaft 10 journaled by bearings not shown. Adjacent one end of the shaft 10 is an inlet area 12. The shaft 10 mounts a rotor, generally designated 14, which may be of conventional construction. Accordingly, the same includes a plurality of compressor blades 16 adjacent the inlet 12. A compressor blade shroud 18 is provided in adjacency thereto and just radially outwardly of the radially outer extremities of the compressor blades 18 is a conventional diffuser 20.

Oppositely of the compressor blades 16, the rotor 14 has a plurality of turbine blades 22. Just radially outwardly of the turbine blades 22 is an annular nozzle 24 which is adapted to receive hot gasses of combustion from an annular combustor, generally designated 26. The compressor system including the blades 16, shroud 18 and diffuser 20 delivers hot air to the annular combustor 26, and via dilution air passages 27, to the nozzle 24 along with the gasses of combustion. That is to say, hot gasses of combustion from the combustor are directed via the nozzle 24 against the blades 22 to cause rotation of the rotor, and thus the shaft 10. The latter may be, of course, coupled to some sort of apparatus requiring the performance of useful work.

A turbine blade shroud 28 is interfitted with the combustor 26 to close off the flow path from the nozzle 24 and confine the expanding gas to the area of the turbine blades 22.

The combustor 26 has a generally cylindrical inner wall 32, and a generally cylindrical outer wall 34. The two are concentric and merge to a necked down area 36 which serves as an outlet from an interior annulus 38 of the combustor 26 to the nozzle 24. A third wall 39, generally concentric with the walls 32 and 34, extends generally radially to interconnect the walls 32 and 34 and to further define the annulus 38.

Opposite of the outlet 36 and adjacent the wall 39, the interior annulus 38 of the combustor 26 includes a primary combustion zone 40 in which the burning of fuel primarily occurs. Other combustion may, in some instances, occur downstream from the primary combustion area 40 in the direction of the outlet 36. As mentioned earlier, provision is made for the injection of dilution air through the passages 27 into the combustor 26 downstream of the primary combustion zone 40 to cool the gasses of combustion to a temperature suitable for application to the turbine blades 22 via the nozzle 24.

In any event, it will be seen that the primary combustion zone 40 is an annulus or annular space defined by the generally radially inner wall 32, the generally radially outer wall 34 and the wall 39.

A further wall 44 is generally concentric to the walls 32 and 34 and is located radially outwardly of the latter to provide a manifold. The wall 44 extends to the outlet of the diffuser 20 and thus serves to contain and direct compressed air from the compressor system to the combustor 26. Mounted on the wall 44 and extending through the wall 34 are injectors, generally designated 46.

In a typical case, there may be six of the injectors 46 and they will be equally angularly spaced from each other about the axis of rotation of the shaft 10. The injectors 46 extend into the primary combustion zone 10 by means of aligned apertures 50 and 52 respectively in the walls 34 and 44 (FIG. 2).

A reinforcing seal 54 may be disposed on the inner surface of the wall 34 about each of the apertures 50 while on the exterior surface of the outer wall 44, a mounting block 56 may be disposed. The mounting block 56 includes an interior opening 58 which aligns with the opening 52 as well as tapped bores 60.

A coupling 62 on the end of a tube 64 which extends to a source of fuel (now shown) has a reduced diameter 66 which receives an apertured retaining flange 68. The retaining flange 68 includes apertures 70 alignable with the tapped bores 60 for receipt of threaded fasteners 71 (only one of which is shown) by which the coupling 62 can be firmly clamped against the mounting plate 56.

In fact, the coupling 62 forms part of the injector 46 and includes a generally circular recess 72 having a central, relatively shallow conical surface 74. An injector body 76 is preferably formed as a casting having an elongated exterior cylindrical surface 78 and an upper end 80 having a cylindrical recess 82. The end 80 is received within the recess 72 of the coupling 60 with the conical surface 74 extending thereinto. Any suitable form of bonding, such as brazing, may be used to secure the components together.

The opposite end 84 of the body 76 includes a frustoconical surface 86. A bore 88 is drilled through the body 76 along an axis 89 which it will be seen is normal (at right angles) to the frustoconical surface 86. The angles involved in forming the frustoconical surface 86 and selecting the axis 89 are such that the latter will be generally tangential to the primary combustion zone 40 (FIG. 1).

The bore 88 includes a large diameter section 90, an intermediate diameter section 92 and a constricted diameter section 94. The enlarged diameter section 90 opens to a side of the body 76, that is, in a cylindrical surface 78 as seen in FIGS. 2 and 3. As best seen in FIG. 2, this opening is in fluid communication with the space between the walls 34 and 44 which define a manifold for the compressed air from the compressor as mentioned previously and thus defines an air inlet to the interior of the bore 88.

Figure 4:
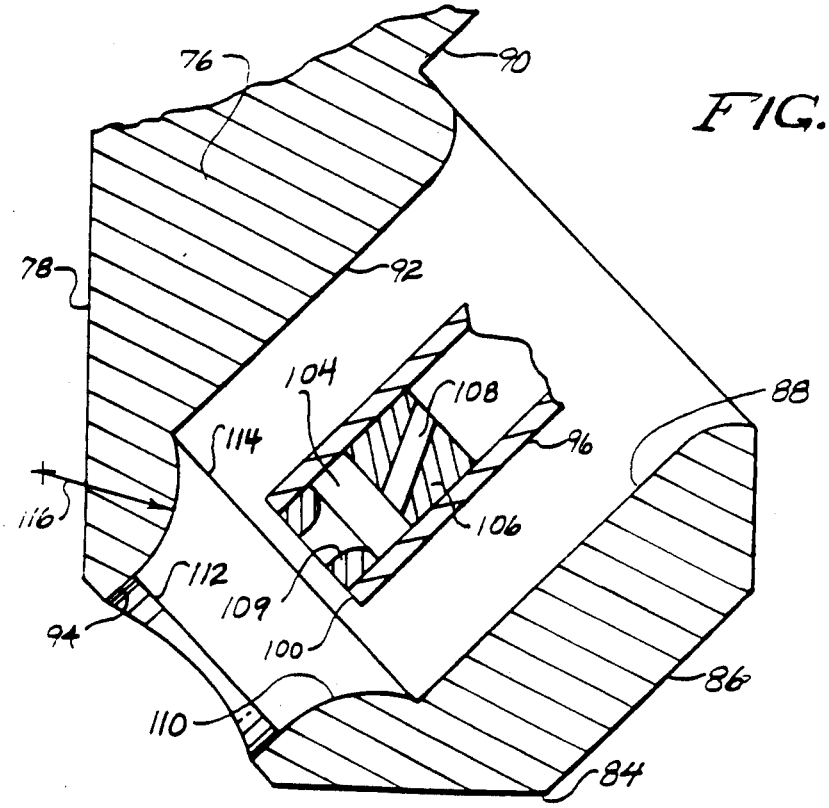
FIG. 4 is an enlarged, fragmentary sectional view illustrating the tip of the fuel injector.

As seen in FIGS. 2 and 4, the constricted diameter section 94 opens through part of the frustoconical surface 86 at the end 84 and serves as a fuel and air outlet from the injector 46 whereby fuel and air may enter the primary combustion zone 40 in a direction generally tangentially thereto.

Returning to FIG. 2, each injector 46 includes a generally J-shaped or slightly bent or curved tube 96. One end 98 of the tube 96 is mounted within the coupling 62 in fluid communication with the interior of the tube 64 to receive fuel therefrom. The opposite end 100 of the tube 96 is an open end and is located within the bore 88. As seen in both FIGS. 2 and 4, the end 100 is normal (at right angles) to and located on the axis 90 of the bore 88.

As best seen in FIG. 3, the body 76 is also provided with a notch 102 in its end 80. The notch 102 extends from the large diameter section 90 of the bore 88 completely to the end 80 and is of sufficient width (FIG. 3) and depth (FIG. 2) so that the tube 96 may pass therethrough to the coupling 62 while being wholly within the cylindrical envelope of the body 76, that is, the cylinder that would be defined by the cylindrical surface 78 if the inlet defined by the enlarged diameter section 90 of the bore 88 were not present. The notch 102 thus serves to simplify assembly of the tube 96 to the body 76. And because the former is wholly within the cylindrical envelope of the latter, assembly of each injector 46 to a combustor is simplified since the same will readily pass the openings 50, 52 without interference from the tube 96.

In a preferred embodiment, the interior of the tube 96, upstream of the end 100, is provided with a fuel swirler, generally designated 104, (FIGS. 2 and 4). The swirler 104 may be in the form of a plug 106 provided with one or more spiraled grooves 108 that serve to impart a swirling motion to fuel as it passes through the tube 96 toward the end 100. The swirler 104 is completed by an orifice 109 at the end 100 of the tube 96 and configured as an interior section of a torus.

Returning to FIG. 4, the restricted diameter section 94 is in the form of a cylinder and is separated from the intermediate diameter section 92 by a convex surface of revolution 110 that faces the air inlet provided by the large diameter section 90. The limits of the surface of revolution are defined by lines 112 and 114 respectively as seen in FIG. 4 and the surface of revolution 110 is to define a venturi surface just above the air fuel outlet from the body 76. The surface of revolution 110 is in fact an interior section of a torus centered on the axis 89 of the bore 88 and having a radius indicated by the arrow designated 116 in FIG. 4.

An important feature of the invention is the relation of the end 100 of the tube 96 to the constriction or venturi surface just identified. A precise location will vary depending upon the particular geometry and dimensioning of the components selected for a particular injector but the principle of location is as follows: the tube end 100 is brought toward the throat of the nozzle, that is, the constriction or venturi surface and stopped at the point where the presence of the tube 96 within the bore 88 in proximity to such throat will begin to increase the resistance to the flow of air through the air-fuel outlet. Stated another way, the end 100 of the tube 96 is brought as close to the constriction as is possible without increasing the resistance to the flow of air through the air fuel outlet of the injector 46.

In general, it is preferable that the swirling means 104 be employed in the invention since it provides for superior atomization of fuel and thus promotes efficient combustion and suppresses the formation of smoke. However, in those instances where superior atomization may not be required, the swirling means 104 may be omitted.

When the swirler 104 is omitted, it is also preferred that the tube 96 include a section of a capillary tube. Such a section serves to minimize or otherwise overcome so-called "manifold head" problems that may occur in turbine engines at high altitudes for low fuel flows. Such manifold head problems if unchecked result in significantly greater fuel flows out of lower injectors in the engine than in physically higher injectors as a result of gravity acting on the column of fuel because, of the low pressure involved and cause inefficient and unreliable combustion.

In some instances, particularly where the swirler 104 is employed, the superior atomization of fuel achieved with an injector made according to the invention allows the same to be additionally utilized as a start injector. In such cases, the injector of the invention serves the dual function of injecting for start-up and injecting for normal operating conditions, and provides a means for omitting start injectors entirely.

Finally, it is noted that FIGS. 2–4 inclusive of the invention are scale drawings and that in the usual case, the overall length of the tube 96 for a small turbine engine with which the injectors are most advantageously employed will be on the order of 20–22 millimeters.

We claim:

1. A fuel injector for a turbine engine comprising:

an elongated, generally cylindrical metal casting having a cylindrical surface terminating in an end having a frustoconical surface;

a bore having an axis normal to said frustoconical surface and extending through said casting to provide an air inlet in said cylindrical surface and a fuel and air outlet in said frustoconical surface, said bore being narrowed at said outlet to provide a constriction thereat;

a curved tube of substantially lesser diameter than said bore and at least partially within said bore to serve as a fuel injecting tube, said tube having an open end on and normal to said axis; and means mounting said tube for locating said open end closely adjacent to said constriction without increasing the resistance to air flow through said constriction.

2. The fuel injector of claim 1 wherein said constriction includes an interior section of a torus to thereby provide a convex surface facing toward said inlet, and a cylindrical section extending from said interior section to said outlet.

3. The fuel injector of claim 1 wherein said casting includes a notch in said cylindrical surface of a width and depth greater than the diameter of said tube and extending from said inlet to an end of said casting opposite said frustoconical surface, said notch receiving part of said tube such that said tube is wholly within the cylindrical envelope of said casting to thereby facilitate assembly of the tube and the casing of said fuel injector and installation of said fuel injector in the combustor of a turbine engine.

4. The fuel injector of claim 1 further including means within said tube for imparting a swirling motion to fuel flowing to said open end.

5. A fuel injector for a turbine engine comprising:

an elongated, generally cylindrical metal casting having a cylindrical surface terminating in an end having a frustoconical surface, a bore having an axis normal to said frustoconical surface, said bore extending through said casting to provide an air inlet in said cylindrical surface and a fuel and air outlet in said frustoconical surface, said bore being narrowed at said outlet to provide a constriction including an interior section of a torus to thereby provide a convex surface facing toward said inlet and a cylindrical section extending from said interior section to said outlet, a bent tube of substantially lesser diameter than said bore disposed at least partially within said bore to serve as a fuel injecting tube, said tube having an open end on and normal to said axis and located substantially as close as possible to said constriction without increasing the resistance of air flow through said constriction, a notch in said cylindrical surface of a width and depth greater than the diameter of said tube and extending from said inlet to an end of said casting opposite said frustoconical surface, said notch receiving part of said tube such that said tube is wholly within the cylindrical envelope of said casting to thereby facilitate assembly of the tube and the casting of said fuel injector and installation of said fuel injectors in the combustor of a turbine engine, and means, within said tube for imparting swirling motion to fuel flowing through said open end.

* * * * *